US007780307B2

(12) United States Patent
Lin

(10) Patent No.: US 7,780,307 B2
(45) **Date of Patent: *Aug. 24, 2010**

(54) ILLIMINATION CONTROL APPARATUS FOR HAND TOOL

(75) Inventor: Hung Wen Lin, Taichung County (TW)

(73) Assignee: Shin Yueh Handtool Co., Ltd., Taiping, Taichung County (TW)

( * ) Notice: Subject to any disclaimer, the term of this patent is extended or adjusted under 35 U.S.C. 154(b) by 4 days.

This patent is subject to a terminal disclaimer.

(21) Appl. No.: 12/287,371

(22) Filed: Oct. 8, 2008

(65) Prior Publication Data

US 2009/0116227 A1 May 7, 2009

(30) Foreign Application Priority Data

Nov. 6, 2007 (TW) ..... 96141822 A

(51) Int. Cl.
*F21V 33/00* (2006.01)

(52) U.S. Cl. ..... 362/119; 362/120; 362/200

(58) Field of Classification Search ..... 362/119–120, 362/200, 205, 253
See application file for complete search history.

(56) References Cited

U.S. PATENT DOCUMENTS 7,188,966 B1 * 3/2007 Lin ..... 362/119
2005/0068764 A1 * 3/2005 Chen ..... 362/119

* cited by examiner

*Primary Examiner*—Anabel M Ton
(74) *Attorney, Agent, or Firm*—Charles E. Baxley

(57) ABSTRACT

An illumination control apparatus for being applied to a hand tool has a modulized structure and easy to be assembled and operated. The illumination control apparatus primarily comprises a modulized switch circuit, and a housing for enclosing the modulized switch circuit. By pressing a pressing switch of the modulized switch circuit, a light emitting element electrically connected to the modulized switch circuit can be controlled to provide or shut illumination thereof. Besides, the illumination control apparatus is firmly affixed to the hand tool by a screwing method.

11 Claims, 5 Drawing Sheets

ILLIMINATION CONTROL APPARATUS FOR HAND TOOL

BACKGROUND OF THE INVENTION

1. Technical Field

The present invention relates to an illumination control apparatus adapted to a hand tool, and more particularly, the illumination control apparatus having a modulized structure and being convenient in both assembling and operating so as to provide additional manageability for use of the hand tool.

2. Description of Related Art

It is usually that a user of a hand tool has to reach out his hand holding the hand tool into interior of machines or assemblies, where is inaccessible to external illumination. In such occasion, the user usually has to hold a movable light-emitting element with his the other hand. As a result, he can only use one hand to alternately operate the hand tool and arrange components to be driven by the hand tool. Besides, when the hand tool has to be operated in a confined space where the light-emitting element may not accommodate therein simultaneously, illumination in operation of the hand tool encounters additional challenges.

In view of the limitations of the conventional approach regarding illumination in operation of hand tools, it is desired to integrate an illumination control apparatus with a hand tool. Moreover, to optimize an assembly of a light emitting element and a hand tool, there is a need for a modulized illumination control apparatus that is easy to manufacture and adaptive to various hand tools.

SUMMARY OF THE INVENTION

In order to improve the existing approach regarding illumination in operation of hand tools, one objective of the present invention is to propose an illumination control apparatus for a hand tool, wherein the illumination control apparatus serves to provide convenient and synchronous illumination in operation of the hand tool.

Another objective of the present invention is to provide an illumination control apparatus for a hand tool, wherein the illumination control apparatus has a modulized structure that is easy to manufacture and assemble, thereby reducing manufacturing costs and assembling time.

Another objective of the present invention is to provide an illumination control apparatus for a hand tool, wherein the illumination control apparatus is capable of firmly combining with the hand tool and is secured from coming off the hand tool in operation.

Still another objective of the present invention is to provide an illumination control apparatus for a hand tool, wherein the illumination control apparatus is ergonomically designed and allows easy operation while preventing from being unintentionally actuated.

Yet another objective of the present invention is to provide an illumination control apparatus for a hand tool, wherein the illumination control apparatus is equipped with a battery chamber assessable through a manageable lid so that batteries in the battery chamber can be easily replaced without disassembling the illumination control apparatus from the hand tool.

To achieve these and other objectives of the present invention, the disclosed illumination control apparatus for a hand tool primarily comprises:

a modulized switching circuit including a pressing switch and two conductive bars for holding and electrically connecting at least one battery;

two conductive pins and a light emitting element, and a housing covering the modulized switching circuit and formed with a switch hole and a depressed portion encircling the switch hole;

wherein the pressing switch, the conductive bars, the conductive pins and the light emitting element are electrically connected though the modulized switching circuit, so that by operating the pressing switch, a loop between the conductive pins and the light emitting element through the conductive bars is established or broken.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein:

FIG. 5 is another sectional drawing of the illumination control apparatus of the present invention and the open-end wrench that are assembled wherein the illumination control apparatus is turned on.

DETAILED DESCRIPTION OF THE PREFERRED EMBODIMENTS

Figure 1:
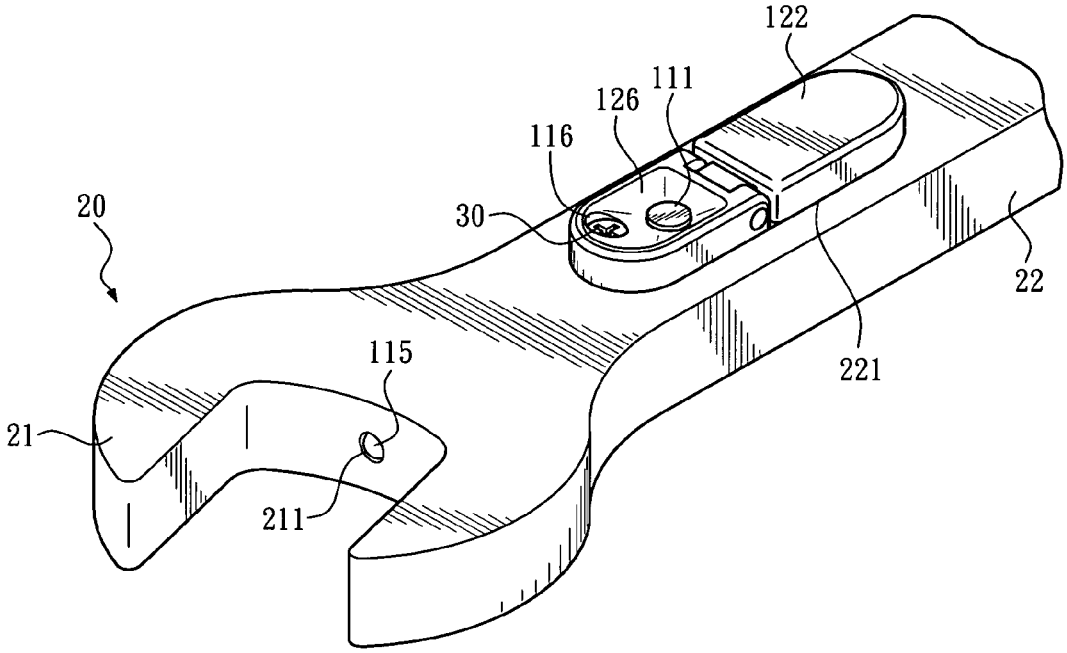
FIG. 1 is a schematic drawing showing an illumination control apparatus of the present invention assembled with an open-end wrench.
Figure 2:
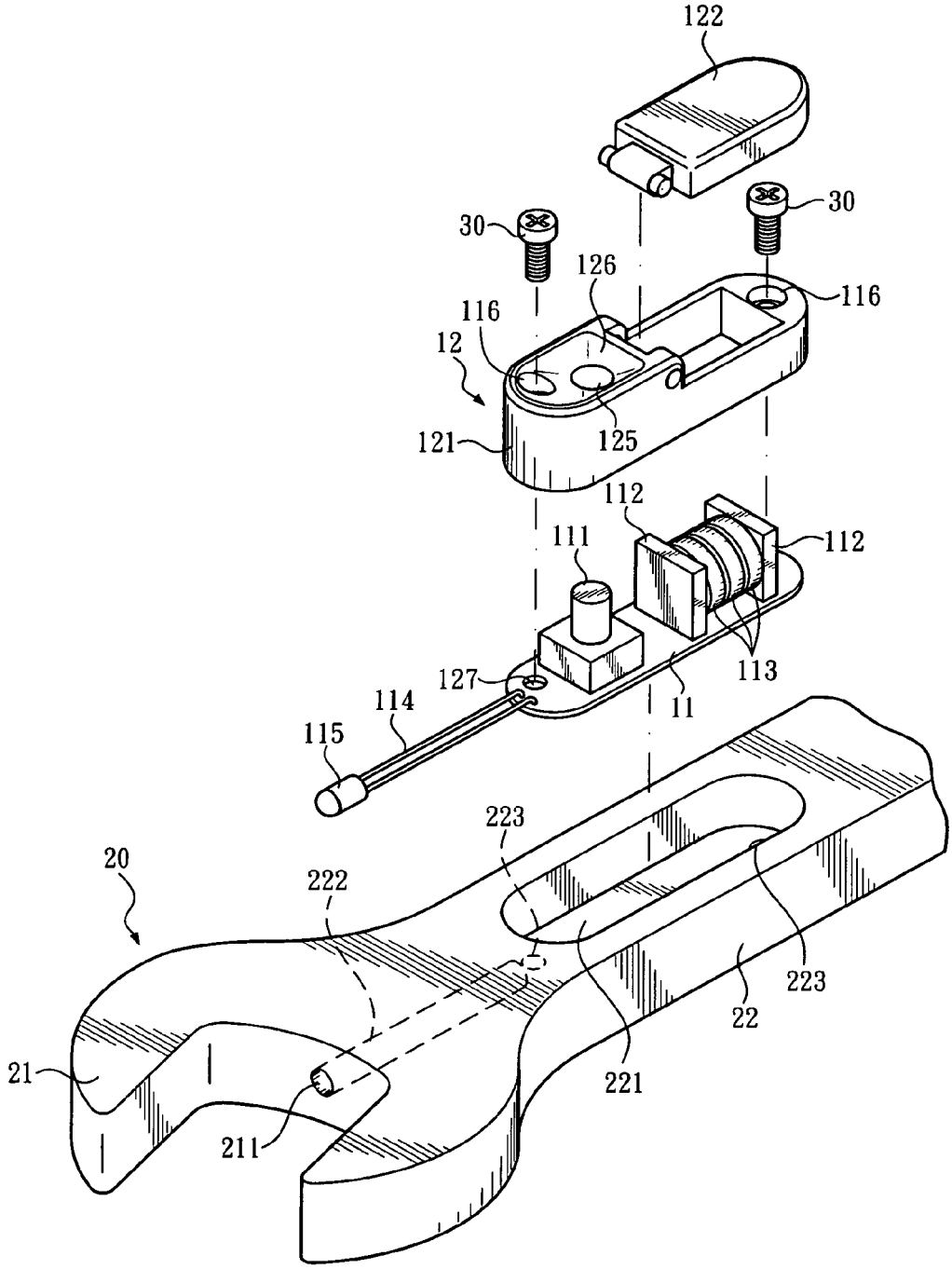
FIG. 2 is a schematic drawing showing the illumination control apparatus of the present invention disassembled form the open-end wrench and exploded.

Please refer to FIGS. 1 and 2 for an illumination control apparatus of the present invention. Though in the following embodiment and the accompanying drawings the illumination control apparatus is assembled with an open-end wrench, it is to be understood by one skilled in the art that the illumination control apparatus is adaptable to any hand tool without limitation.

According to FIG. 2, the open-end wrench 20 has at least one working end 21 and one gripping shank 22. An accommodating recess 221 is provided concavely on the gripping shank 22. A channel 222 communicates the gripping shank 22 and the working end 21 while an opening 211 is formed at the working end 21 in communication with the channel 222.

Figure 3:
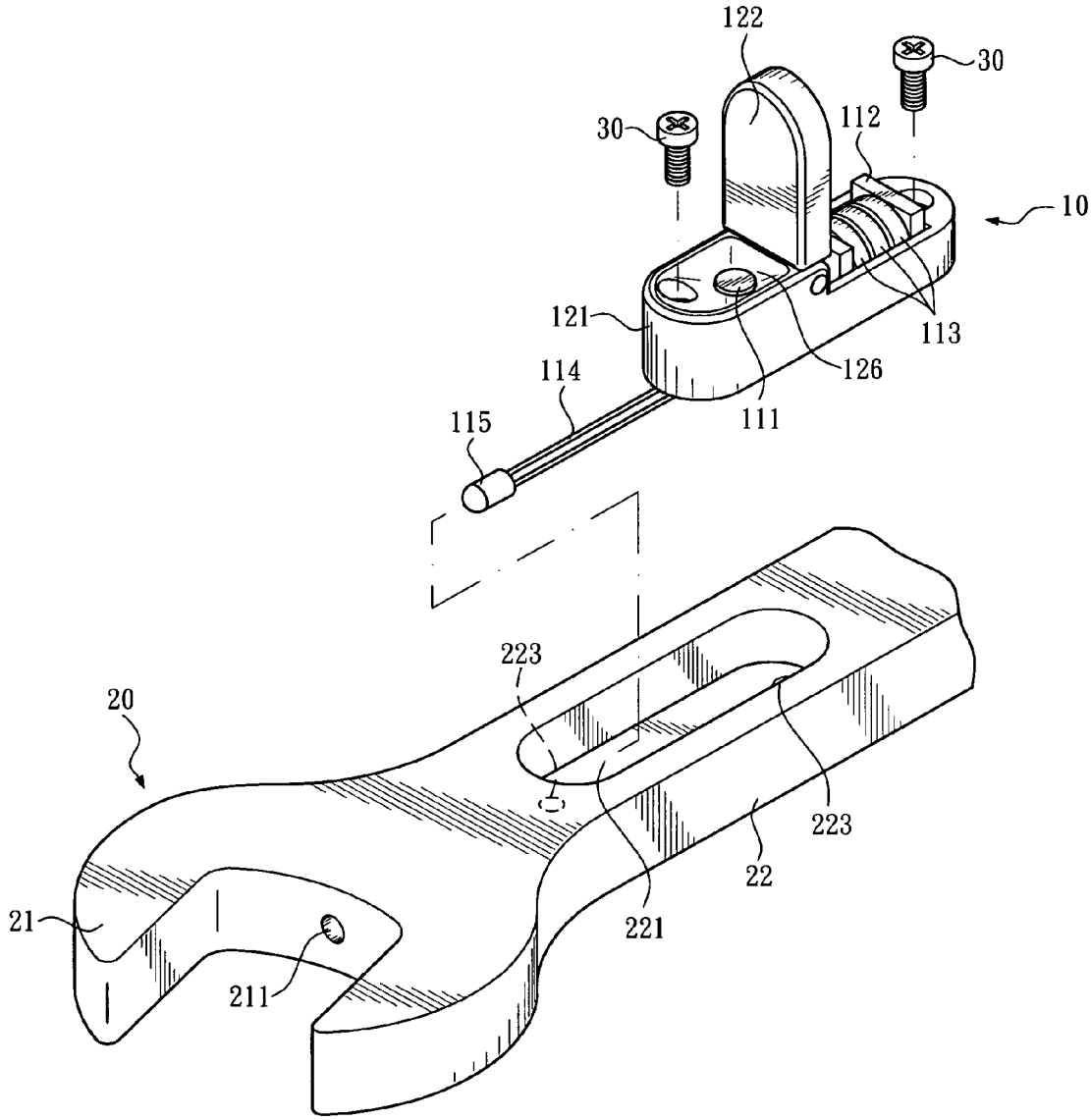
FIG. 3 is a schematic drawing showing the illumination control apparatus of the present invention to be assembled with the open-end wrench.

The illumination control apparatus 10 of the present invention can be clearly seen in FIG. 3 and primarily comprises a modulized switching circuit 11 and a housing 12 covering the modulized switching circuit 11.

The modulized switching circuit 11 includes a pressing switch 111 and two conductive bars 112. The two conductive bars 112 serve to hold and electrically connect a plurality of batteries 113. Although in the present embodiment, the batteries 113 are 1.55V mercury cells, it is to be understood that the batteries 113 may be alkaline batteries, solar cells, or any other types of batteries capable of providing efficient electric power. Two conductive pins 114 and a light emitting element 115 extend outward from one end of the modulized switching circuit 11. In the present embodiment, the light emitting element 115 is a light-emitting diode (LED). According to the above structure, the batteries 113, the conductive bars 112, the pressing switch 111, the conductive pins 114 and the light emitting element 115 are electrically connected so that the pressing switch 111 can be operated to allow the light emitting element 115 to provide or shot illumination thereof.

Referring to FIGS. 1 to 6, the housing 12 comprises a body 121 and a lid 122. The lid 122 is pivotally connected to an upper edge of the body 121 and when the lid 122 is lifted, the batteries 113 between the two conductive bars 112 of the modulized switching circuit 11 are exposed to the exterior so as to allow the batteries 113 to be removed and replaced. Besides, seeing FIG. 6, the body 121 further has a groove 123 while the lid 122 further has a flange 124 designed to be detachable coupled with the groove 123 so that when the lid 122 is closed to the body 121, the flange 124 is coupled with the groove 123 and the lid 122 is secured beside the body 121 from unintentionally lifted.

In addition, a switch hole 125 and a depressed portion 126 encircling the switch hole 125 are provided at the body 121 of the housing 12. The switch hole 125 is in positional correspondence to the pressing switch 111 of the modulized switching circuit 11. Thereby, when the housing 12 and the modulized switching circuit 11 are assembled with each other, the pressing switch 111 appears at the switch hole 125 and is accessible to a user for being operated to turning on or shutting off the light emitting device 115.

Figure 4:
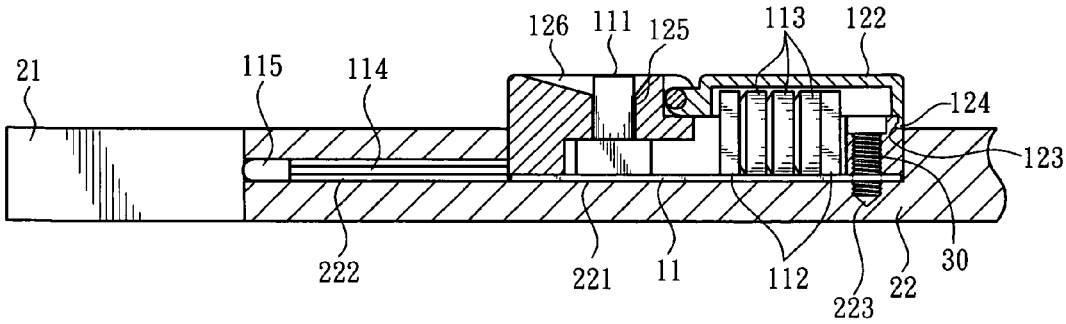
FIG. 4 is a sectional drawing of the illumination control apparatus of the present invention and the open-end wrench that are assembled.
Figure 5:
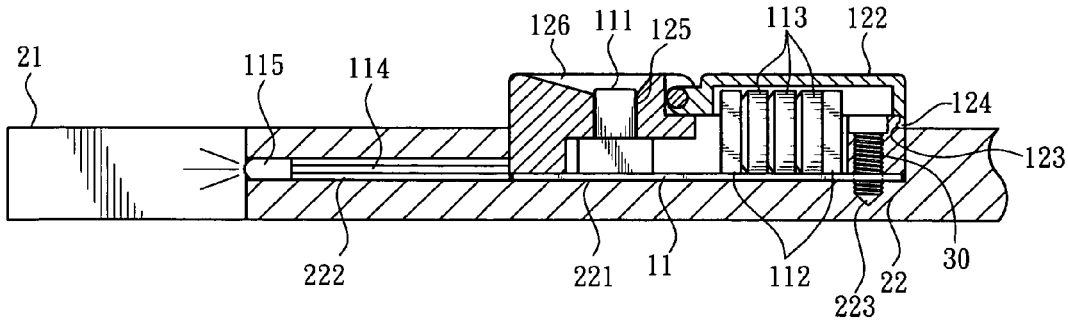
Figure 6:
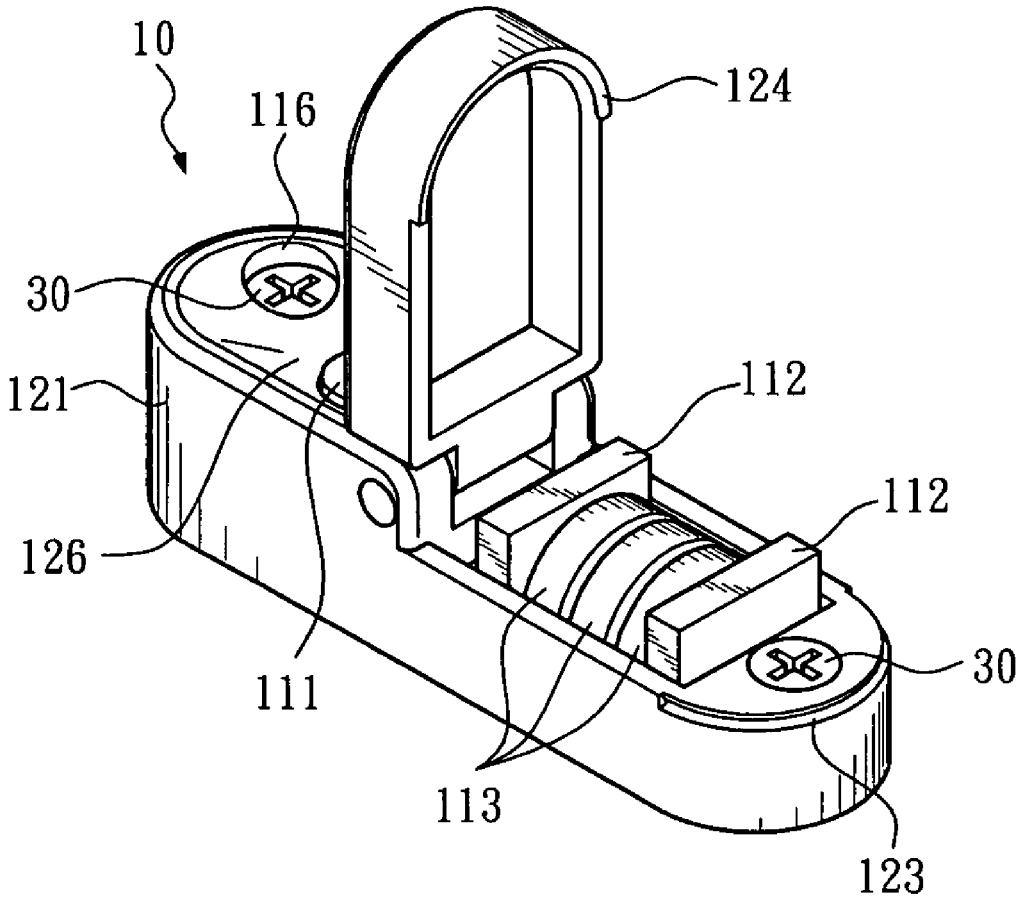
FIG. 6 is another schematic drawing showing the illumination control apparatus of the present invention assembled with an open-end wrench, wherein a lid of a battery chamber of the illumination control apparatus is lifted.

The depressed portion 126 encircling the switch hole 125 has a centripetal slope that is ergonomically designed so as to facilitate the user's pressing the pressing switch 111 and prevent the pressing switch 111 from being unintentionally pressed when the hand tool is left in idleness. Please refer to FIGS. 4 and 5, showing positions of the pressing switch 111 with respect to the switch hole 125 of the housing 12 when the pressing switch 111 is not pressed and pressed. As can be seen in the drawings, when the pressing switch 111 is not pressed, its upper edge remains lower than a surface of the housing 12. Therefore, even when the open-end wrench 20 is randomly placed on a surface with the illumination control apparatus 10 thereon facing the surface, the pressing switch 111 is in no contact with the surface and can be secured from being unintentionally pressed so that the light emitting element 115 is free from being unintentionally turned on through the conductive bars 112 and the conductive pins 114.

Now the description is directed to the manner the modulized switching circuit 11 of the illumination control apparatus 10 assembled with the open-end wrench 20. Referring back to FIG. 2, the accommodating recess 221 at the gripping shank 22 of the open-end wrench 20 is shaped according to the modulized switching circuit 11 and the housing 12 of the illumination control apparatus 10 and is provided with two threaded holes 223 at a bottom thereof. Meantime, the modulized switching circuit 11 and the housing 12 are also provided with threaded holes 116, 127 corresponding to the threaded holes 223 of the accommodating recess 221. Thereby, when the conductive pins 114 of the modulized switching circuit 11 are received in the channel 222 passing through the gripping shank 22 of the open-end wrench 20 and the light emitting element 115 is positioned at the opening 221 of the working end 21 of the open-end wrench, two screws 30 can pass through the threaded holes 127 of the housing, the threaded holes 116 of the modulized switching circuit 11 and get coupled with the threaded holes 223 at the bottom of the accommodating recess 221. Consequently, the open-end wrench 20, the modulized switching circuit 11 and the housing are firmly combined so that the illumination control apparatus 10 is secured from coming off the open-end wrench 20 in operation.

Although the particular embodiment of the invention has been described in detail for purposes of illustration, it will be understood by one of ordinary skill in the art that numerous variations will be possible to the disclosed embodiment without going outside the scope of the invention as disclosed in the claims.

What is claimed is:

1. An illumination control apparatus for a hand tool, said illumination control apparatus comprising:
- a modulized switching circuit including a pressing switch and two conductive bars for holding an electrically connecting at least one battery;
- two conductive pins;
- a light emitting element; and
- a housing covering the modulized switching circuit, and having a switch hole and a depressed portion encircling the switch hole;
- wherein the pressing switch, the conductive bars, the conductive pins and the light emitting element are electrically connected though the modulized switching circuit, so that the light emitting is turned on or turned off by operating the pressing switch.

2. The illumination control apparatus of claim 1, wherein the housing and the modulized switching circuit are combined by a screw manner.

3. The illumination control apparatus of claim 1, wherein the housing further comprises a liftable lid so that when the lid is lifted, the battery between the conductive bars on the modulized switching circuit is exposed and becomes accessible.

4. An illumination control apparatus for a hand tool, said illumination control comprising:
- a modulized switching circuit including a pressing switch and two conductive bars for holding and electrically connecting at least one battery;
- two conductive pins;
- a light emitting element; and
- a housing covering the modulized switching circuit, and having a switch hole and a depressed portion encircling the switch hole;
- wherein the pressing switch, the conductive bars, the conductive pins and the light emitting element are electrically connected though the modulized switching circuit, so that the light emitting element is turned on or turned off by operating the pressing switch wherein the housing and the lid are pivotally connected.

5. A hand tool having an illumination control apparatus, said hand tool comprising:
- the illumination control apparatus, comprising a modulized switching circuit including a pressing switch and two conductive bars for holding a electrically connecting at least one battery;
- two conductive pins;
- a light emitting element; and
- a housing covering the modulized switching circuit and formed with a switch hole and a depressed portion encircling the switch hole;
- wherein the pressing switch, the conductive bars, the conductive pins and the light emitting element are electrically connected though the modulized switching circuit, so that the light emitting element is turned on or turned off by operating the pressing switch; and
- the hand tool, having at least one working end and one gripping shank, the gripping shank including an accommodating recess for receiving the modulized switching circuit and the housing of the modulized switching circuit, a channel passing through the gripping shank and the working end for receiving the conductive pins of the illumination control apparatus, and an opening at the working end communicating with the channel for receiving the light emitting element of the illumination control apparatus.

6. The hand tool of claim 5, wherein the illumination control apparatus and the accommodating recess of the hand tool are combined by a screw manner.

7. The hand tool of claim 5, wherein the housing and the modulized switching circuit of the illumination control apparatus are combined by a screw manner.

8. The hand tool of claim 5, wherein the housing of the illumination control apparatus further comprises a liftable lid so that when the lid is lifted, the battery between the conductive bars on the modulized switching circuit is exposed and becomes accessible.

9. The hand tool of claim 8, wherein the housing and the lid are pivotally connected.

10. The hand tool of claim 8, wherein the housing further comprises a body closed by the lid, in which the body has a groove and the lid has a flange designed to be detachably coupled with the groove.

11. The illumination control apparatus of claim 4, wherein the housing further comprises a body closed by the lid, in which the body has a groove and the lid has a flange designed to be detachably coupled with the groove.

* * * * *